United States Patent [19]

Olesen et al.

[11] Patent Number: 4,705,202

[45] Date of Patent: Nov. 10, 1987

[54] CARTRIDGE PLIER STAPLER

[75] Inventors: Paul Olesen, Bellmore; Frank H. Lin, Jackson Heights, both of N.Y.

[73] Assignee: Swingline Inc., Long Island City, N.Y.

[21] Appl. No.: 879,764

[22] Filed: Jun. 27, 1986

[51] Int. Cl.[4] ..... B25C 5/02; B25C 5/04

[52] U.S. Cl. ..... 227/153; 227/155

[58] Field of Search ..... 227/85, 87–89, 227/155, 131, 120, 124, 90, 153, 155; 81/381, 383, 383.5

[56] References Cited

U.S. PATENT DOCUMENTS

| | | | |
|---|---|---|---|
| 4,572,419 | 2/1986 | Klaus et al. | 227/155 |
| 4,573,625 | 3/1986 | Olesen et al. | 227/95 |
| 4,623,084 | 11/1986 | Olesen | 227/155 |

*Primary Examiner*—Donald R. Schran
*Assistant Examiner*—James L. Wolfe
*Attorney, Agent, or Firm*—Pennie & Edmonds

[57] ABSTRACT

A hand-held plier type stapler having a first rearward handle to which an anvil is pivotally mounted. The first handle provides a housing for a belt stapler head for forming and driving staples. A second forward handle is connected to the anvil to pull the anvil down as the second handle is moved down and rearward and as such movement continues a link mechanism operates the stapler head to form and drive a staple.

4 Claims, 6 Drawing Figures

CARTRIDGE PLIER STAPLER

BACKGROUND OF THE INVENTION

Staplers with pivotal anvils have been used and proposed in patents (Juilfs U.S. Pat. Nos. 2,687,522 and 2,943,327). Clinching devices have also been used in hand tools for increasing forces applied (see, for example, Carlson U.S. Pat. No. 1,541,248). Further, use of the toggle principle in staple machines is disclosed in U.S. patent application Ser. No. 818,566 filed Jan. 13, 1986 to Paul Olesen which application is owned by the assignee of the present application.

None of the prior devices have provided a tool with a pivotal anvil and an improved staple driving linkage for convenient hand operation.

SUMMARY OF THE INVENTION

Broadly, the invention comprises a hand-held plier stapler having a first handle on which an anvil is pivotally mounted and has housed in it a stapler head unit having a front portion including a driver from which staples are driven by such driver moving in a path substantially perpendicular to the anvil. A second handle normally positioned in front of the head unit and mounted for rotation movement about the first handle, is connected to and caused during its initial movement to move toward the staple head unit causing the compression of the workpiece by the anvil's pivotal movement toward the head unit.

Further movement of the second handle moves a driver link piece connected to the driver (the link piece slides up and down in the first handle) upward and toward the staple head unit. As the second handle movement continues it moves the driver link and connected driver until the staple is driven and clinched against the anvil.

The staple head unit receives an insertable replaceable staple cartridge which cartridge is held in operable position by a pivotal cartridge latch mounted on the first handle. The latch includes resilient legs, a pivot section and a finger-operable lever movable against the tension of the resilient legs to deform them and permit sufficient lever movement to release the cartridge.

It is a feature of this invention that the second handle is in front of the driver-former linkage for ease of operation.

It is a further feature that the latch is unitary in construction for ready operation as the cartridge is inserted and removed.

DESCRIPTION OF THE PREFERRED EMBODIMENT

Figure 1:
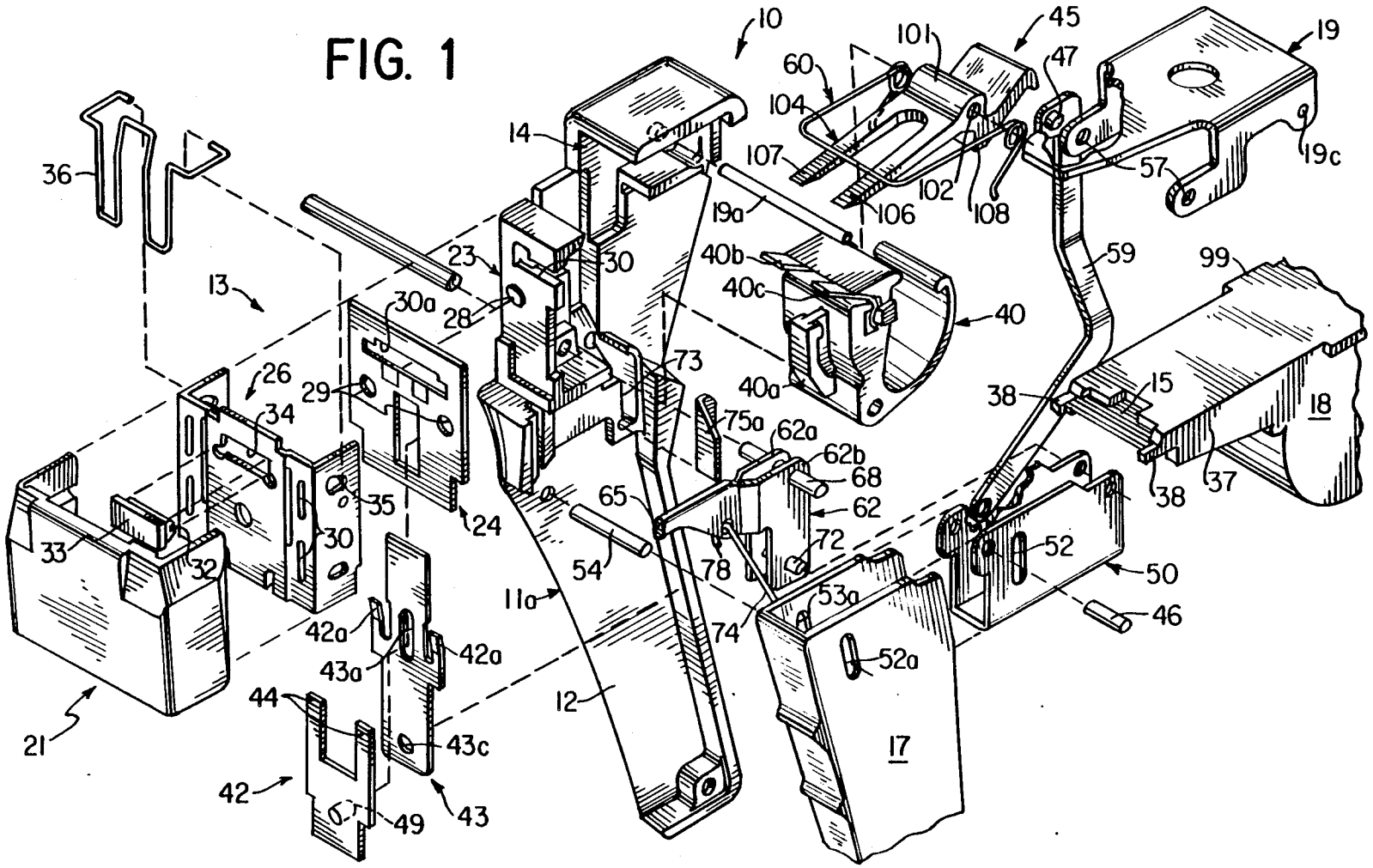
FIG. 1 is an exploded perspective view of the plier stapler of the present invention.

Referring to FIG. 1, hand-held plier stapler 10 includes housing unit 11 formed in two (2) substantially identical mating plastic halves (one half 11*a* shown in FIG. 1 with the other half 11*b* shown in FIG. 5) which unit 11 in turn consists of first rearward handle 12, staple head unit 13, staple cartridge housing area 14 and staple driver link plate 62. Also shown are second forward handle 17, staple blank belt cartridge 18, pivotal anvil 19, and removable front cover section 21.

Staple head unit 13 includes a housing support piece 23 which is part of units 11*a* and 11*b*, a metal face plate 24 and staple head piece 26. Face plate 24 is mounted on support piece 23 using locating nipples 28 which receive circular opening 29 in plate 24. Head 26 is spaced from plate 24 by spacer lugs 30 which protrude from head 26. Such spacing provides a staple discharge channel 20 defining the path through which staple blanks pass as they are formed and driven toward anvil 19 (see FIG. 2). The stapling mechanism of the present invention follows in principle the stapling machine disclosed in U.S. Pat. No. 4,573,625 owned by the assignee of the present application.

Stapling is accomplished by the delivery of staple blanks seriatim in belt form to groove 32 in staple block 33. Staple block 33 is mounted in opening 34 in head 26 and held against the head 26 by spring 36 engageable in head side holes 35. The staple belt 15 is delivered to staple block 33 by cartridge 18 fitted through slot 30 within piece 23 and through opening 30*a* in plate 24. The cartridge shute 37 is located with its projections 38 extending through slot 30 and plate opening 30*a*. Projections 38 abut staple head 26. The staple blanks are formed and driven in a single upward stroke by former 42 and driver 43. The driver 43 drives the former 42 upwardly causing the prongs 44 of former 42 to engage and bend the staple blank to form a staple. As driver 43 continues in its upward movement, its flexible arms 42*a* are cammed to permit driver 43 to slide in frictional engagement relative to the former 42. Also shown in FIG. 1 is spring belt advance unit 40 and cartridge latch 45.

Now with reference to all figures, the arrangement for driving upwardly and thereafter retracting the driver 43 with respect to the pivotal anvil 19 includes second handle 17 mounted through guide mount plate unit 50 about guide rod 54 which rod 54 is in turn mounted in the first handle spaced apart bushings 54*a*, 54*b* (not shown). Second handle 17 includes mount plate unit 50 fastened with screws 50*a*, 50*b*. Mount plate unit 50 carries slots 52, 53 (not shown) as aligned with slots 52*a*, 53*a* in handle 17 (see FIG. 1). Anvil spring 60 is mounted on anvil 19 through holes 19*c*, 19*d* (not shown) using axle pin 19*a*. Main spring 74 (which is a stronger spring than anvil spring 60) pulls driver link 62 down which causes handles 12, 17 to assume a normally open position (see FIG. 2). Anvil control arms 58, 59 are mounted at upper anvil pivot pin 57 and on lower axle 46. Driver link 62 includes spaced apart plates 62*a*, 62*b*.

Figure 2:
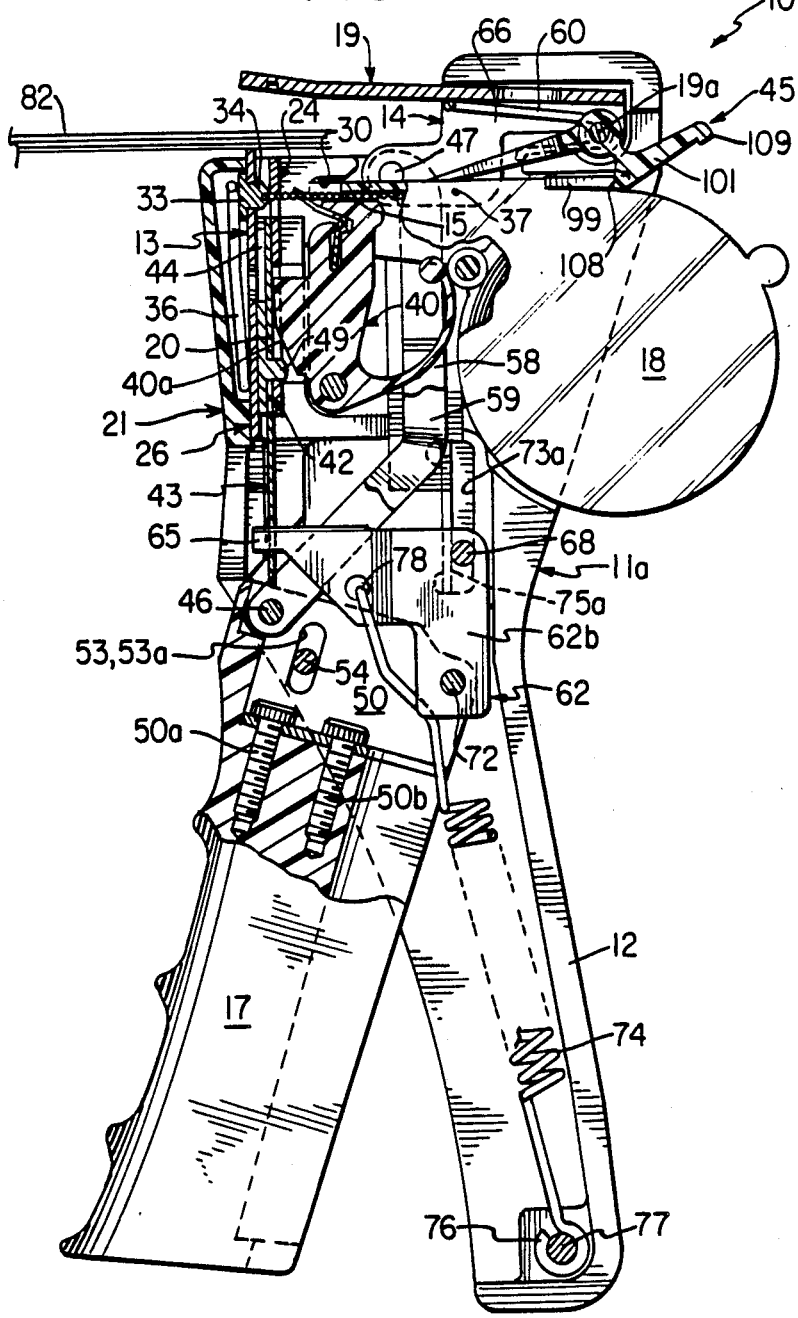
FIG. 2 is a partially broken away side elevational view of the plier stapler showing the stapler in its inactive relaxed position.
Figure 3:
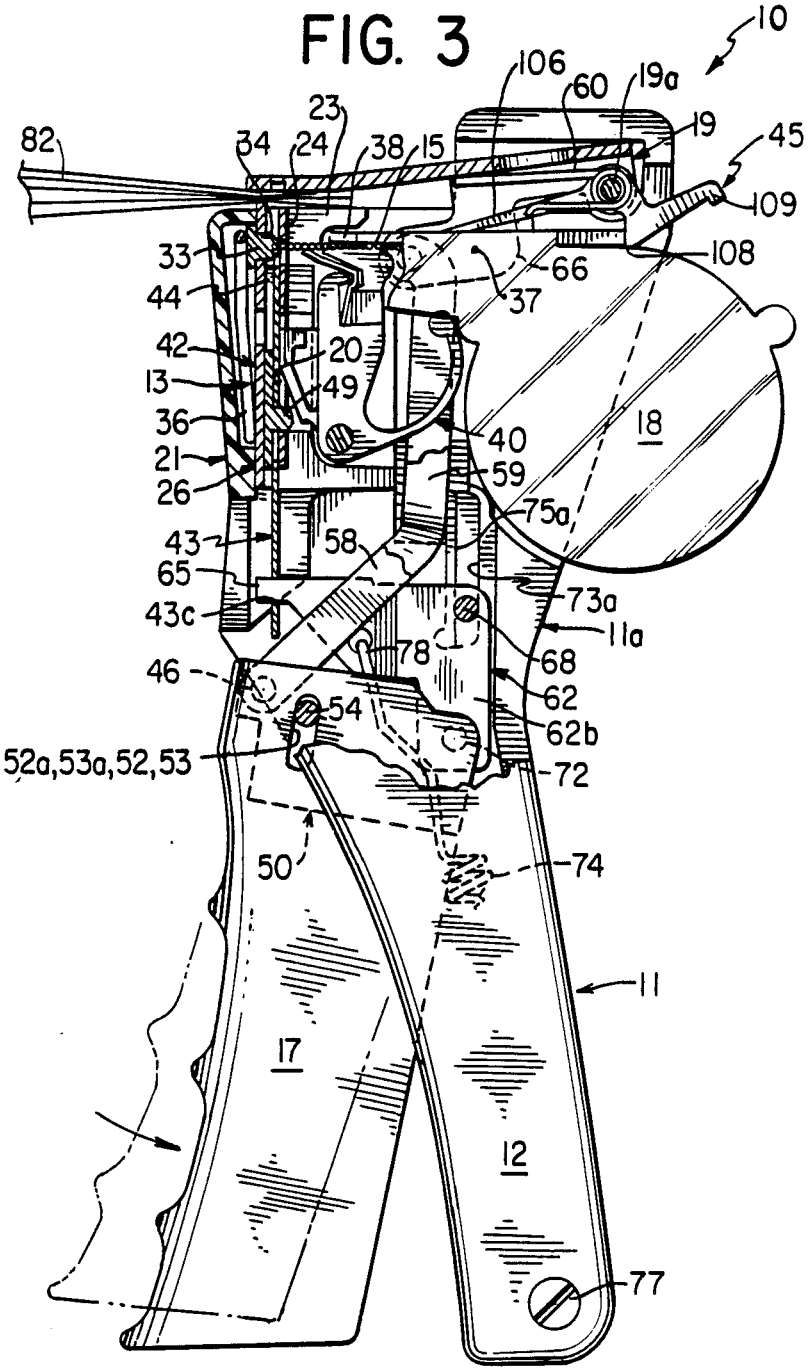
FIG. 3 is a similar side elevational view of the invention showing the stapler in a partially operated position.

Pivot axle pin 19*a* also carries cartridge retainer latch 45. Anvil side arms 66, 67 are pivotally connected to the upper ends of anvil puller levers 58, 59 about pin 47. Levers 58, 59 are connected at their lower ends to plate unit 50 using pin 46 (shown in FIGS. 2–4). Driver link 62 is pivotally connected to second handle 17 through rearward handle pin 72. Link 62 rides up and down in slots 73, 73*a* against wear plates 75, 75*a* through driver link guide pin 68. Coil spring 74, with lower hook 76 engaging handle pin 77 and upper hook 78 engaging driver link plate 62, urges the driver 43 downwardly into the retracted position (FIG. 2). Former 42 carries projection 49 which rides up and down in driver slot 43*a* and engages cam surface 40*a* of unit 40 during the forming-driving stroke to advance belt pushers feet 40*b*, 40*c* to the right as shown in FIG. 4.

Figure 5:
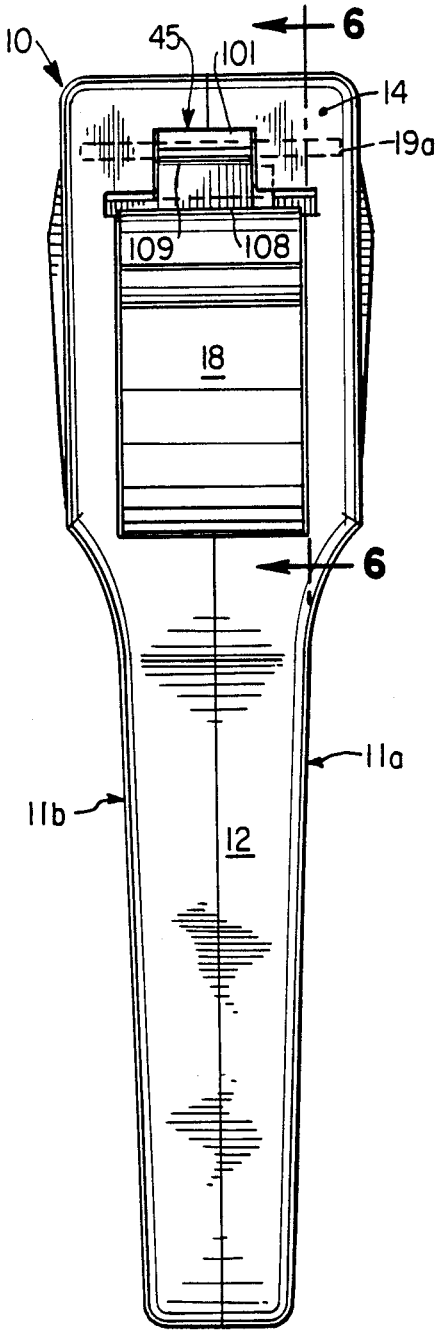
FIG. 5 is a front elevational view of the plier stapler.
Figure 6:
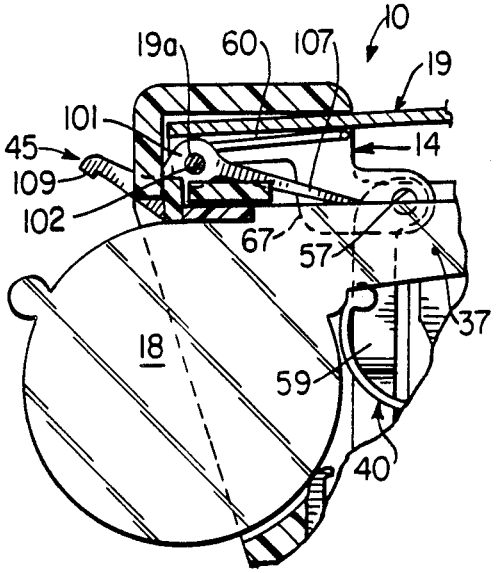
FIG. 6 is a sectional view taken along line 6—6 of FIG. 5 showing the latch feature of the invention.

Turning to FIGS. 1, 5 and 6, cartridge latch 45 includes body 101 having transverse passageway 102 housing axle 19*a*, about which latch 45 is pivotally mounted through a suitable pin. Body 101 includes integrally formed U-shaped leg section 104 which includes two (2) spaced-apart flexible legs 106, 107. Flexible legs 106, 107 are made of resilient material. Preferably, legs 106, 107 are integrally formed as part of body 101 but may be separately made and attached by suitable means. Latch engagement ledge 108 engages cartridge ridge 99 and latch thumb piece 109 extends upwardly from ledge 108. When latch thumb piece 109 is lifted up legs 106, 107 flex and ledge 108 raises past ridge 99 to release cartridge.

In the operation of the plier tool 10, the workpiece 82 (FIG. 2) is placed between anvil 19 and the stapler head 26 with the handles 12, 17 in their relaxed spaced-apart positions and with the anvil 19 in its upper position (FIG. 2). Anvil spring 60 maintains anvil 19 spaced from staple head unit 13 and stronger main spring 74 maintains handles 12, 17 in a spaced apart position. In this rest position, handle housing guide pin 54 is in an intermediary position in front handle 17 slots 52*a*, 53*a*. To set the staple, forward handle 17 is moved backwardly toward first handle 12 causing anvil arms 58, 59 and attached anvil U-shaped levers 66, 67 to move downwardly pulling anvil 19 down against the workpiece 82 (see FIG. 3). As the handle 17 is moved further toward first handle 12, the point of principal rotation of the handle 17 becomes forward handle pin 46. With respect to FIG. 3, further movement of handle 17 about pivot pin 46 causes pin 72 to raise driver plate unit 62. Plate unit 62 carries a nose 65 which engages opening 43*c* in driver 43. Driver 43 has not yet reached belt 15 having its lead staple blank in slot 34 of forming block 33. Guide pin 68 is moved up in spaced-apart slots 73, 73*a* (slot 73 is in housing half 11*a* and 73*a* is in housing 11*b*).

Figure 4:
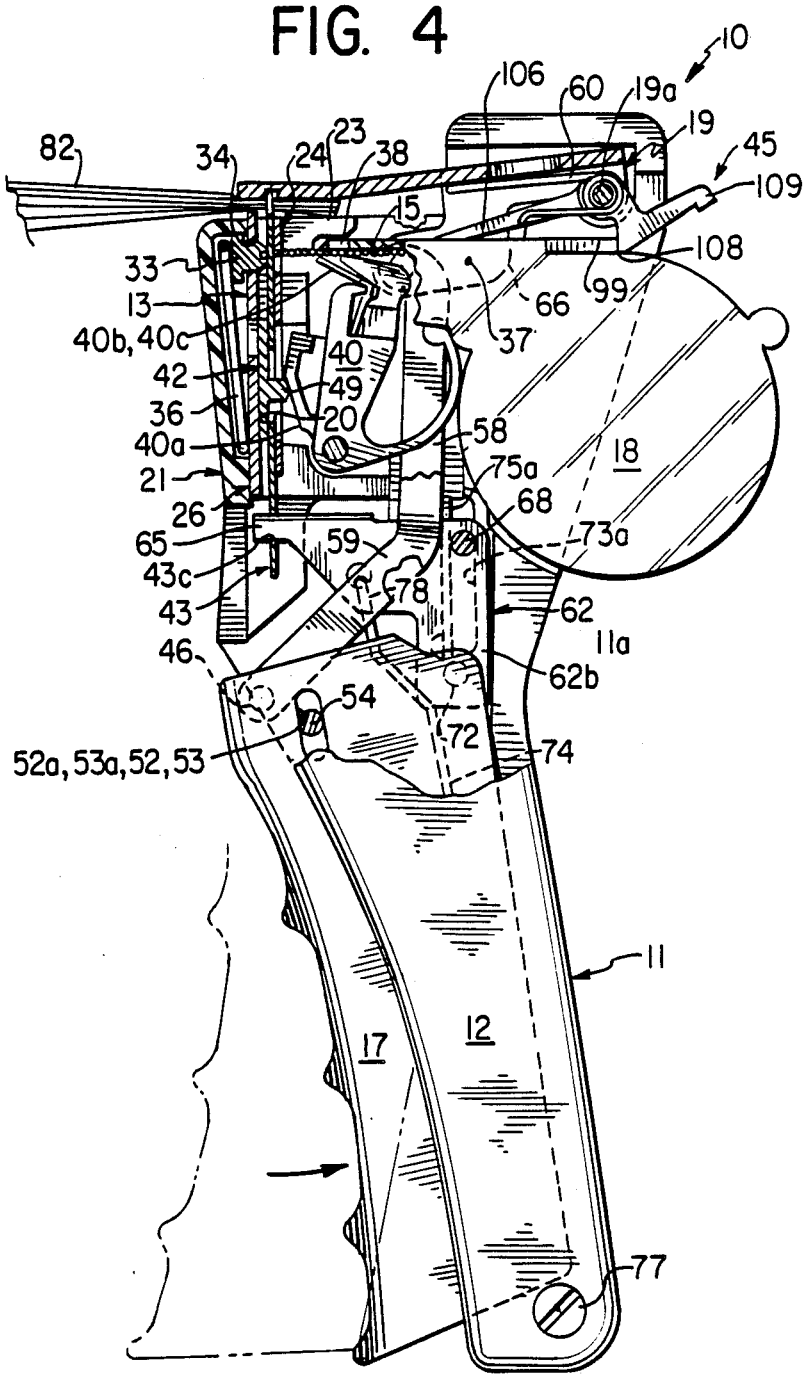
FIG. 4 is a similar side elevational view of the plier stapler operated to a fully clinched position to set the staple.

Turning finally to FIG. 4, continuing second handle 17 rotation about pin 46 causes the driver link plate unit 62 to move further upward causing former 42 and driver 43 to form and drive a staple. Driver link plate unit 62 continues to ride in slots 73, 73*a* as it moves during the power stroke.

The tool is capable of stapling workpieces of varying thicknesses. The thickness of the workpiece dictates the extent of downward movement of the anvil levers 66, 67 before the anvil's engagement with (and compression of) workpiece 82 prevents the anvil arms further downward movement. Slots 52*a*, 53*a* permit the second handle 17 operation to adjust to the varying workpiece thicknesses. The variable thickness of workpiece 82 is compensated for by movement of handle 17 within slots 52*a*, 53*a* sliding up and down past handle housing pin 54.

We claim:

1. A hand-held tool having an anvil (19), a housing (11) including a staple cartridge (18), a first rearward handle (12) and a staple discharge channel (20) and a second forward handle (17) mounted on the first handle (12) which tool provides space between the discharge channel (20) and anvil (19) to receive the workpiece, the improvement comprising (a) an anvil (19) mounted on the first rearward handle (12) for pivotal movement about an anvil axis (19*a*) toward and away from the staple discharge channel (20);

(b) staple drive means (42, 43) movable in the discharge channel (20) along a path substantially perpendicular to the anvil (19);

(c) anvil control arms (58, 59) each having end portions with an upper end portion pivotally mounted on the anvil on upper pivot means (57) forward of the anvil axis (19*a*) and the other lower end portion connected to the second forward handle;

(d) handle mounting means (54, 52*a*, 53*a*, 46) on the first handle for mounting the second handle including (a) a guide rod (54) fixed to the first handle (12) and positioned in slots (52*a*, 53*a*) formed in the second handle (17) and including (b) forwardly positioned pivotal connector means (46) located forward of the upper pivot means (57) for connecting the lower ends of the anvil control arms (52*a* 53*a*) to the second handle (17) such mounting means permitting the second hand (17) to move down and rearwardly with the anvil (19) and to rotate relative to the first handle (12) until the anvil engages the workpiece;

(e) driver link means (62) pivotally connected to the second handle (17) about pin (72) means positioned rearward of the pivotal connector means (46) and the link means (62) including slide projection means (68) and such link means (62) slidably mounted on the first handle (12) for movement up and down on the first handle (12); and (f) non-pivotal connector means (50) for connecting the staple drive means (42, 43) to the driver link means (62) with the connector means (50) and slide projection means (68) movable up and down in spaced-apart parallel paths, one path (73, 73*a*) being forward of the other path (42, 43)

whereby the anvil (19) is first brought against the workpiece and thereafter the second handle (17) is rotated about the pivotal connector means (46) of the lower ends of the anvil control arms (58, 59) until the driver link means (62) slides upwardly to raise the staple driver means (42, 43) a sufficient distance to drive the staple.

2. The tool of claim 1 in which the staple blank cartridge is releasably latched in the housing using a pivotal latching means having latch ledge means, flexible legs and an operable thumb piece.

3. The tool of claim 2 having in addition spring means for urging the handles apart when the tool is at rest.

4. The tool of claim 2 in which the latching means is pivotal about the anvil axis and in which the flexible legs ride on the staple blank cartridge to urge the latch ledge means toward the cartridge for accomplishing latching of the cartridge.

* * * * *